United States Patent [19]

Wallace et al.

[11] Patent Number: 5,029,661

[45] Date of Patent: Jul. 9, 1991

[54] SKATEBOARD WITH PROPULSION, VISUAL AND AURAL ENHANCEMENT

[76] Inventors: Terry A. Wallace, 3202 Old Oak Walk, Greenville, N.C. 27834; Harry C. Hopkins, Rte. 5, Box 883, Williamston, N.C. 27892; Lyvone L. Wallace, 3202 Old Oak Walk, Greenville, N.C. 27834

[21] Appl. No.: 406,259

[22] Filed: Sep. 12, 1989

[51] Int. Cl.[5] ..... B62M 1/00

[52] U.S. Cl. ..... 180/165; 180/54.2; 280/87.042

[58] Field of Search ..... 180/165, 54.2; 280/87.041, 87.042, 215, 11.115, 212; 446/464; 185/39

[56] References Cited

U.S. PATENT DOCUMENTS

| | | | |
|---|---|---|---|
| 1,654,985 | 1/1928 | McCarthy | 280/212 |
| 3,751,062 | 8/1973 | White, Sr. | 280/87.042 |
| 4,241,534 | 12/1980 | Larsson et al. | 446/464 |
| 4,270,764 | 6/1981 | Yamada | 280/87.042 |
| 4,568,308 | 2/1986 | Itoh | 446/464 |
| 4,683,986 | 8/1987 | Darda et al. | 446/464 |
| 4,715,475 | 12/1987 | Minoru | 446/464 |

*Primary Examiner*—Andres Kashnikow
*Assistant Examiner*—Richard Camby
*Attorney, Agent, or Firm*—Darby & Darby

[57] ABSTRACT

A skateboard with propulsion, visual and aural enhancement. The propulsion enhancement is provided by a transmission device which is mounted adjacent at least one wheel of the skateboard. The transmission device includes a spring for storing energy during one mode of operation and releasing energy during a second mode. A lever controlled by the foot of the user shifts between the two modes. The transmission may also include a retarding force for controlling the speed of the skateboard. Various devices, e.g., lights, sound, smoke and hubcaps, are included which add to the attractiveness of the skateboard.

20 Claims, 1 Drawing Sheet

SKATEBOARD WITH PROPULSION, VISUAL AND AURAL ENHANCEMENT

BACKGROUND OF THE INVENTION

1. Field of the Invention

The present invention relates to a skateboard and, more particularly, to a skateboard having enhanced features such as propulsion enhancement as well as visual and aural enhancement.

2. Background Prior Art

Skateboards are a popular toy for exercise and enjoyment. The conventional skateboard is totally powered by the user and has no features to control speed and efficiency of movement.

The user typically stands with one foot on the body of the board and pushes with the other foot in the direction opposite to that in which he desires the skateboard to move. This results in an increase in speed followed by a gradual decrease to zero speed depending on the power of the push, and the frictional retarding force between the surface contacted by the wheels and the wheels themselves.

Inexperienced users are frequently hurt when going downhill because the typical skateboard picks up too much speed due to the pull of gravity. The awareness of parents of this danger in many cases restricts use of a skateboard to older children who have sufficient maturity not to ride down hills that are so steep that the speed of the skateboard exceeds the user's ability to successfully slow or stop himself or herself.

The conventional board also does not provide a means to travel on level ground or upgrades without physical effort. Users may also become quickly frustrated with the need for continuous periodic pushing to keep the board in motion. This limits the distance the user can go at maximum speed without resting, hence it shortens the enjoyable time when both feet may be on the board and no pushing is necessary to keep the board in motion.

During this pleasurable non-pushing time, a novice user can relax and rest his pushing leg. An experienced user can do fancy body moves to make the board zigzag or stand on its back wheels, but he or she must continue to push to get any consistency of, or increase in, speed.

The conventional skateboard is not particularly stylish, has a rather simple unadorned, flat elongated body for standing, and has wheels that spin independent of their axles. Enjoyment consists simply of pushing, coasting and whatever motions the user can maneuver the board into. Thus the attention a user can attract is limited to the skill with which he can manipulate the board, since the board itself is more or less unadorned.

OBJECTS OF THE PRESENT INVENTION

It is a primary object of the present invention to provide a skateboard with improved performance capabilities, in particular, by provision of a mechanism to limit the speed of the skateboard and by provision of a mechanism to provide propulsion energy to the skateboard.

It is also an object of the present invention to incorporate aural and visual effects in a skateboard.

SUMMARY OF THE PRESENT INVENTION

In accordance with the invention, a skateboard comprises an elongated body portion having a top, a bottom and a longitudinal axis. A front axle, which is immovably mounted transverse to said axis on the bottom of the body portion, has a pair of wheels rotatably mounted on its opposite ends. A rear axle is immovably mounted transverse to the axis on the bottom of the body portion and it also has a pair of wheels rotatably mounted on its opposite ends. Transmission means are affixed to the bottom of the body portion adjacent at least one wheel of the skateboard. This transmission means is driven by the wheel for storing energy during a first mode of operation and for driving the wheel by the stored energy during a second mode of operation. Means, controlled by the operator, are provided for selecting either the first mode or the second mode.

In a preferred embodiment a spring is provided for storing the energy and for driving the wheel. A slipping mechanism is included for preventing the spring from overwinding. The slipping mechanism may also provide a retarding force to the wheel so as to control the speed of the skateboard.

For a better understanding of the present invention, reference is made to the following description and accompanying drawings while the scope of the invention will be pointed out in the appended claims.

DESCRIPTION OF THE PREFERRED EMBODIMENTS

Figure 1:
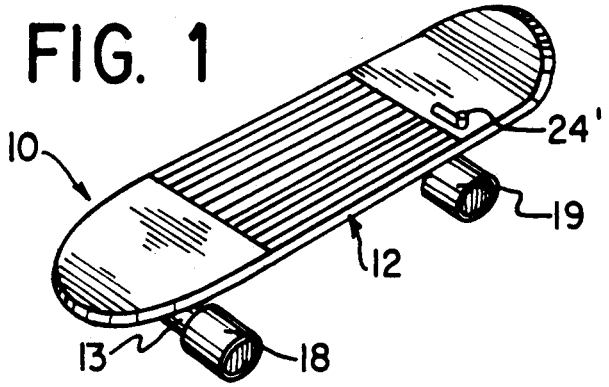
FIG. 1 is a perspective view of one embodiment the skateboard of the present invention.
Figure 2:
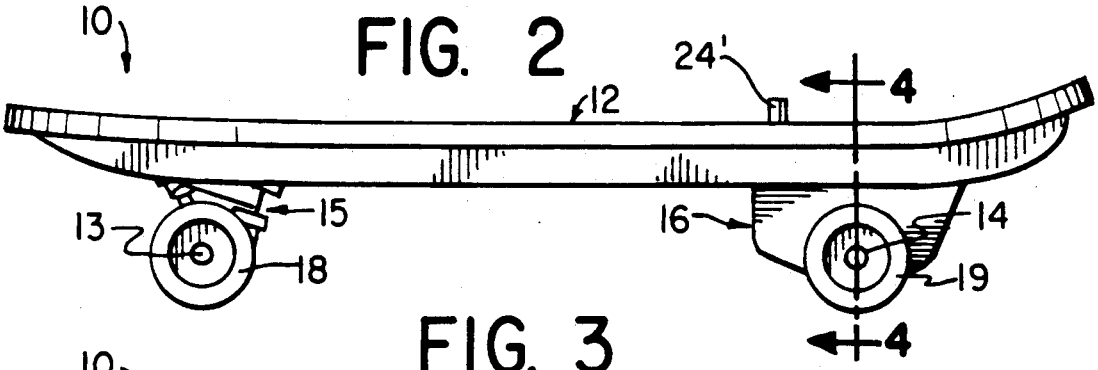
FIG. 2 is a side view of the embodiment of the skateboard of the present invention shown in FIG. 1.
Figure 3:
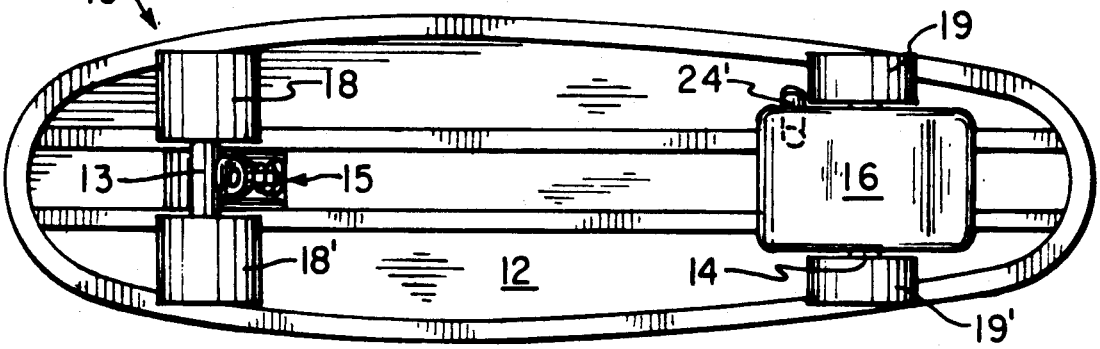
FIG. 3 is a bottom view of the embodiment of the present invention shown in FIG. 1.

Referring initially to FIGS. 1–3, there is shown a skateboard 10 in accordance with the present invention. The skateboard 10 includes an elongated body portion 12, a front axle 13 immovably mounted transverse to the longitudinal axis of the body portion and a rear axle 14, also mounted transverse to the axis. The front axle 13 has a pair of wheels 18, 18' rotatably mounted on opposite ends of the front axle; the rear axle 14 has a pair of wheels 19, 19' rotatably mounted on opposite ends of the rear axle 14. The axles 13 and 14 are fastened to the body portion 12 by respective mounting arrangements 15 and 16. Lever 24' extends through the body portion 12, the purpose of which will be discussed in detail below.

Part of the mounting mechanism 16 for the rear axle includes a transmission mechanism 20 which is mounted adjacent one of the rear wheels (19 or 19'). Alternatively, the mechanism may be mounted adjacent one of the front wheels (18 or 18') as well. The transmission mechanism 20 enables the selected rear wheel to be a source of energy to propel the skateboard when the user wishes to coast or expend less physical energy.

Figure 4:
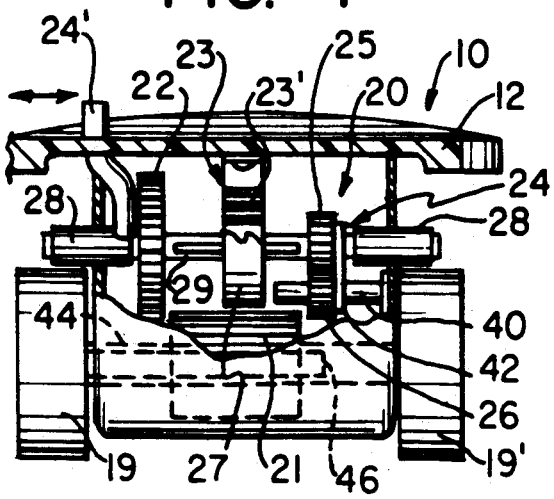
FIG. 4 is a schematic representation of the transmission assembly for the skateboard of the present invention.

The transmission mechanism 20 is depicted in greater detail in FIG. 4. There the mechanism is shown affixed to one of the rear wheels 19 or 19'. The mechanism 20 includes a first gear 21 which operates as either the drive or driven gear depending on the mode of operation. During a first mode, energy will be derived from the motion of wheel 19 or 19' and stored in a spring mechanism 23.

Axle 14 is a split axle so that either (a) a portion rotates with wheel 19 and a portion rotates with wheel 19', or (b) it has a coaxial shaft with a fixed outer shaft 44 on which wheel 19' is mounted for independent rotation and an inner shaft 46 that rotates with wheel 19. Regardless of the type of split axle, gear 21 is fastened to the portion that rotates with wheel 19. It is important in guiding a skateboard to allow the left and right wheels to rotate at different speeds in order to execute turns.

The transmission includes a linkage 24 on which are located gears 22, 25. These gears are fixed to and rotate with an inner axle 29 of linkage 24 which is contained within a nonrotating, but axially slidable outer axle 28. The entire linkage 24 is axially slidable by operation of user-control lever 24' in the direction of the arrows shown in FIG. 4. The lever 24' is connected to outer non-rotating axle 28.

In the first mode of operation, lever 24' is moved to its extreme right position in FIG. 4. As a result, gear 22 is brought into engagement with gear 21. As the skateboard is propelled, wheel 19 turns, causing gear 21 to turn and gear 22 to turn. The rotation of gear 22 causes inner axle 29 to rotate and this operates to wind the spring 23' in the spring mechanism 23. A slipping mechanism 27 is preferably included in spring mechanism 23 to prevent overwinding of the spring. The slipping mechanism 27 can have an additional function as a retarding force to movement of wheel 19 when the spring is fully wound. Thus, speed control of the skateboard may be effected.

At a time desired by the user, the lever 24' can be moved by the user's foot to its extreme left position in FIG. 4 (see arrow) to initiate a second mode of operation. In the second mode, the gear 22 is moved out of engagement with gear 21. The movement of linkage 24 causes gear 25 to move to the right and to move gear 26 into engagement with gear 21. Gear 26 is slidable on a rod 40 and is moved with gear 25 by means of a connecting frame 42. The purpose of gear 26 is to create motion reverse to the direction of rotation of gear 25.

During the first mode, energy was stored in spring 23. As soon as gear 22 becomes disengaged from gear 21, spring 23 begins to unwind, thus causing inner shaft 29 to stop rotating in one direction and to begin rotating in the opposite direction. Gear 25 couples this motion to gear 26 so that it is now moving in the direction of gear 21, even though shaft 29 has reversed its direction. If the movement of lever 24' is fast enough, this movement of gear 26, driven by the unwinding of the spring 23, is transferred to gear 21 when gear 26 engages with it. This aids the forward motion of wheel 19 through the part of axle 14 connected to it. In this condition, the wound spring will unwind to drive wheel 19 through gears 25 and 26 until it is completely unwound.

An intermediate position of linkage 24 (as shown in FIG. 4), where neither gear 25 nor gear 22 is engaged, will function as a neutral (uncoupled) position of the transmission.

Various similar arrangements of transmission control are disclosed in U.S. Pat. Nos. 4,241,534, 4,715,475, 4,568,308, 4,662,477, 4,683,986 and 4,241,534. The disclosures of these patents are incorporated herein by reference.

While a single transmission mechanism 20 is shown in FIG. 4, another identical mechanism may be incorporated to drive the other rear wheel for balanced operation.

Figure 5:
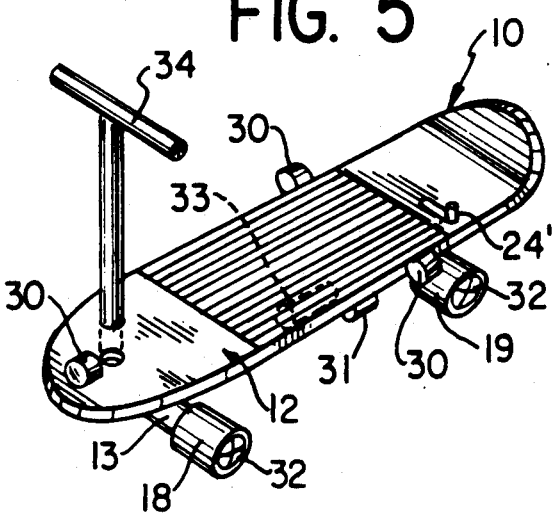
FIG. 5 is a perspective view of an embodiment of the present invention incorporating various visual and aural features for enhancing the attractiveness of the present invention.

FIG. 5 illustrates various means which may be incorporated with the skateboard to enhance its attractiveness and attention getting qualities. These include lights 30 (beacon or disco type) a real smoke source combined with a "choo-choo" sound 31 (the frequency of which increases with the speed of the board), hubcaps 32, and programmed train horn 33. All of these elements may be electrically powered by a battery mounted on the underside of the body portion 12. A removable handle 34 for a child may also be included. Various similar aural and visual devices may be added to the board for increasing attractiveness and attention. A battery 33, mounted to the underside of the board, supplies the electrical power.

While the foregoing description and drawings represent the preferred embodiments of the present invention, it will be obvious to those skilled in the art that various changes and modifications may be made therein without departing from the true spirit and scope of the present invention.

What is claimed is:

1. A skateboard comprising:

an elongated body portion having a top, a bottom and a longitudinal axis;

a front axis mounted transverse to said axis on the bottom of said body portion;

a pair of wheels rotatably mounted on opposite ends of said front axle;

a rear axle mounted transverse to said axis on the bottom of said body portion;

a pair of wheels rotatably mounted on opposite ends of said rear axle;

transmission means affixed to the bottom of said body portion adjacent at least one wheel of said skateboard and driven by said wheel for storing energy during a first mode of operation when the skateboard is moving in one direction and for driving said wheel during a second mode of operation by said stored energy when said skateboard is moving in said one direction; said transmission means including a slipping mechanism which prevents additional energy from being stored once a predetermined amount of energy is stored, said slipping mechanism maintaining the predetermined amount of energy stored by the transmission means; and means, controlled by a skateboard operator, for selecting either said first mode or said second mode.

2. A skateboard as in claim 1 wherein said transmission means is adjacent one of the wheels of said rear axle.

3. A skateboard as in claim 1 wherein said transmission means is adjacent one of the wheels of said front axle.

4. A skateboard as in claim 2 wherein a further transmission means is incorporated adjacent and in cooperation with the other rear wheel to provide balanced operation for said skateboard.

5. A skateboard as in claim 1 wherein said transmission means includes a spring element for storing and releasing energy.

6. A skateboard as in claim 5 wherein said transmission means includes a gear pass between said wheel and said spring element for storing energy in said spring element.

7. A skateboard as in claim 5 wherein said transmission means includes two gear passes included between said spring element and said wheel for providing a driving force to said wheel.

8. A skateboard as in claim 5 wherein a driving gear is affixed to said wheel and rotates with said wheel for providing a driving force for winding said spring element.

9. A skateboard as in claim 8 wherein a driven gear is affixed to said wheel and rotates with said wheel for being driven by said spring.

10. A skateboard as in claim 8 wherein said driving gear and said driven gear are the same gear.

11. A skateboard as in claim 1 wherein a controllable lever shifts said transmission means between the first mode and the second mode.

12. A skateboard as in claim 10 including a third mode wherein energy is neither stored from nor released to said wheel.

13. A skateboard as in claim 5 wherein said slipping mechanism prevents said spring element from being overwound.

14. A skateboard as in claim 13 wherein said slipping mechanism also provides a retarding force to said wheel so as to control the speed of the skateboard.

15. A skateboard as in claim 1 also including safety lights affixed to opposite sides of said body portion.

16. A skateboard as in claim 1 further including means to produce a noise, the frequency of which increases with the speed of the board, for attracting attention.

17. A skateboard as in claim 1 including means to produce a flashing light for attracting attention.

18. A skateboard as in claim 1 including means to produce smoke for attracting attention.

19. A skateboard as in claim 1 further including an optional handle, said handle being removably mountable on the forward tip of said body portion.

20. A skateboard as in claim 1 wherein said wheels include hubcaps.

* * * * *